US009095756B2

(12) United States Patent
Decker

(10) Patent No.: US 9,095,756 B2
(45) Date of Patent: Aug. 4, 2015

(54) SPORTS TRAINING SYSTEM WITH DRILL TOWER

(71) Applicant: Sport Innovations, LLC, Kansas City, MO (US)

(72) Inventor: Gregory K. Decker, Kansas City, MO (US)

(73) Assignee: Sport Innovations, LLC, Kansas City, MO (US)

( * ) Notice: Subject to any disclaimer, the term of this patent is extended or adjusted under 35 U.S.C. 154(b) by 126 days.

(21) Appl. No.: 14/046,697

(22) Filed: Oct. 4, 2013

(65) Prior Publication Data

US 2014/0100061 A1 Apr. 10, 2014

Related U.S. Application Data

(60) Provisional application No. 61/709,720, filed on Oct. 4, 2012.

(51) Int. Cl.

| | |
|---|---|
| ***A63B 69/00*** | (2006.01) |
| *A63B 5/22* | (2006.01) |
| *A63B 71/02* | (2006.01) |

(52) U.S. Cl.

CPC ..... *A63B 69/0071* (2013.01); *A63B 69/0075* (2013.01); *A63B 5/22* (2013.01); *A63B 2071/026* (2013.01); *A63B 2209/10* (2013.01); *A63B 2210/50* (2013.01)

(58) Field of Classification Search

CPC ..... A63B 69/0071; A63B 69/0075; A63B 47/002; A63B 2225/093

USPC ..... 473/447, 450, 458, 464, 422, 451, 433, 473/417; 434/248

See application file for complete search history.

(56) References Cited

U.S. PATENT DOCUMENTS

| | | | | |
|---|---|---|---|---|
| 715,442 | A * | 12/1902 | Van Horn | 229/115 |
| 2,659,525 | A * | 11/1953 | Wikstrom | 229/110 |
| 2,816,652 | A * | 12/1957 | Clark | 206/525 |
| 3,891,136 | A * | 6/1975 | Woeste | 229/115 |
| 4,426,821 | A * | 1/1984 | Moore et al. | 52/646 |
| 5,221,088 | A | 6/1993 | McTeigue et al. | |
| 5,324,026 | A * | 6/1994 | Conlon et al. | 473/450 |
| 8,460,131 | B2 * | 6/2013 | Harvey | 473/447 |
| 2005/0092820 | A1 * | 5/2005 | Chekroune | 229/102 |
| 2006/0252581 | A1 * | 11/2006 | Wegryn | 473/446 |
| 2007/0202969 | A1 * | 8/2007 | Girard | 473/447 |

* cited by examiner

*Primary Examiner* — Mitra Aryanpour

(74) *Attorney, Agent, or Firm* — Law Office of Mark Brown, LLC; Christopher M. DeBacker; Mark E. Brown

(57) ABSTRACT

A system and method for sports training utilizing a drill tower apparatus. The drill tower is collapsible and light weight. The tower can be stood on an end to form a tower structure, or may be placed on its side for use in numerous training drills. The tower can be used as an obstacle or as a stand for holding a ball or other sports-related object. The towers may also feature a weighted ring for holding the towers in place during drills. The towers are collapsible and easily transportable, by folding the towers into a collapsed position and placing the towers into a portable bag with multiple weight rings.

10 Claims, 5 Drawing Sheets

SPORTS TRAINING SYSTEM WITH DRILL TOWER

CROSS-REFERENCE TO RELATED APPLICATION

This application claims priority in U.S. Provisional Patent Application Ser. No. 61/709,720, filed Oct. 4, 2012, which is incorporated herein by reference.

BACKGROUND OF THE INVENTION

1. Field of the Invention

The present invention relates generally to a system and method for sports training, and more specifically to a drill-tower focused sports training system and method for teaching basketball and other sports.

2. Description of the Related Art

For many years, thousands of elementary, junior high, high school, AAU and even college basketball coaches, and coaches in other sports, have relied on traditional small orange cones and cumbersome fold-out chairs to run their players through various skill drills in gyms across the country. These items are rarely available in gyms and usually are not available in the destination gyms to which they are travelling for practices, clinics or camps.

These aforementioned items are usually used by coaches to mimic opposing players on the court or field, or are used as basic obstacles for players to maneuver around during their skill drills. As an example, folding chairs are often used to place and steady a basketball so the player can bend and grab the ball off the chair at a certain height level, much like receiving a pass from another player. Various basketball skill drills are executed by these coaches to develop basketball player fundamentals, preparing players for the next game or the next level of play in their development. Because of the competitive sports environment today, many kids work by themselves on their driveways or neighborhood parks, either because of an increased desire to practice on their part because of a lack of fellow players to practice with. These players are hungry to become better players and they want to gain a skills advantage over their competition.

What is needed is a system for sports training that is highly portable, light-weight, and customizable to allow for multiple types of drills. The aforementioned traditional items are costly, cumbersome, and not readily available in all gymnasium settings. An ideal system would allow the coach to easily transport the training system from location to location for a reusable and familiar sports training system for the players.

Heretofore there has not been available a system or method for sports training with the advantages and features of the present invention.

BRIEF SUMMARY OF THE INVENTION

The present invention generally provides a sports training system including at least one drill tower. The drill tower is generally comprised of a collapsible assembly with multiple folding panels and flaps. A preferred embodiment includes three panels, each having a base flap which folds out near the base of each panel. A closure flap allows the ends of the panel to be fastened together, forming a generally triangular cross-section.

A weighted ring may optionally be slid over the top of the assembled drill tower resting on three base flaps to add stability at the base. The weighted ring sits atop the base flaps, thereby holding them to the ground to prevent accidental toppling of the tower.

A player or coach may place a ball on top of the tower to simulate receiving a pass. The player may then grab the ball from the top of the tower and run a route toward a basketball goal or other target. A number of additional drill towers may be placed along the route in varying positions and orientations to simulate other players or obstacles.

Alternatively, drill towers may be placed horizontally on the ground with one of the three panels laid flat against the ground. This allows players to practice plyometric exercises by jumping or stepping over the towers.

Another alternative drill incorporates the weighted ring. One or more rings may be placed along a path, which may also include drill towers set up as obstacles. The rings provide agility drills where players must step into and out of the ring without disturbing the ring.

The entire system is designed to be compact when not in use, such that a plurality of towers and rings may be folded up and placed into a single carry-along bag.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the disclosed subject matter are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, base, front, back, right and left refer to the invention as oriented in the view being referred to. The words "inwardly" and "outwardly" refer to directions toward and away from, respectively, the geometric center of the embodiment being described and designated parts thereof. Forwardly and rearwardly are generally in reference to the direction of travel, if appropriate. Said terminology will include the words specifically mentioned, derivatives thereof and words of similar meaning.

A preferred embodiment of the present invention relies upon a drill tower 4 which can be placed at various locations on a basketball court, a football field, or other sporting venue for use in practicing various drills.

II. Preferred Embodiment Sports Training System 2

Figure 1:
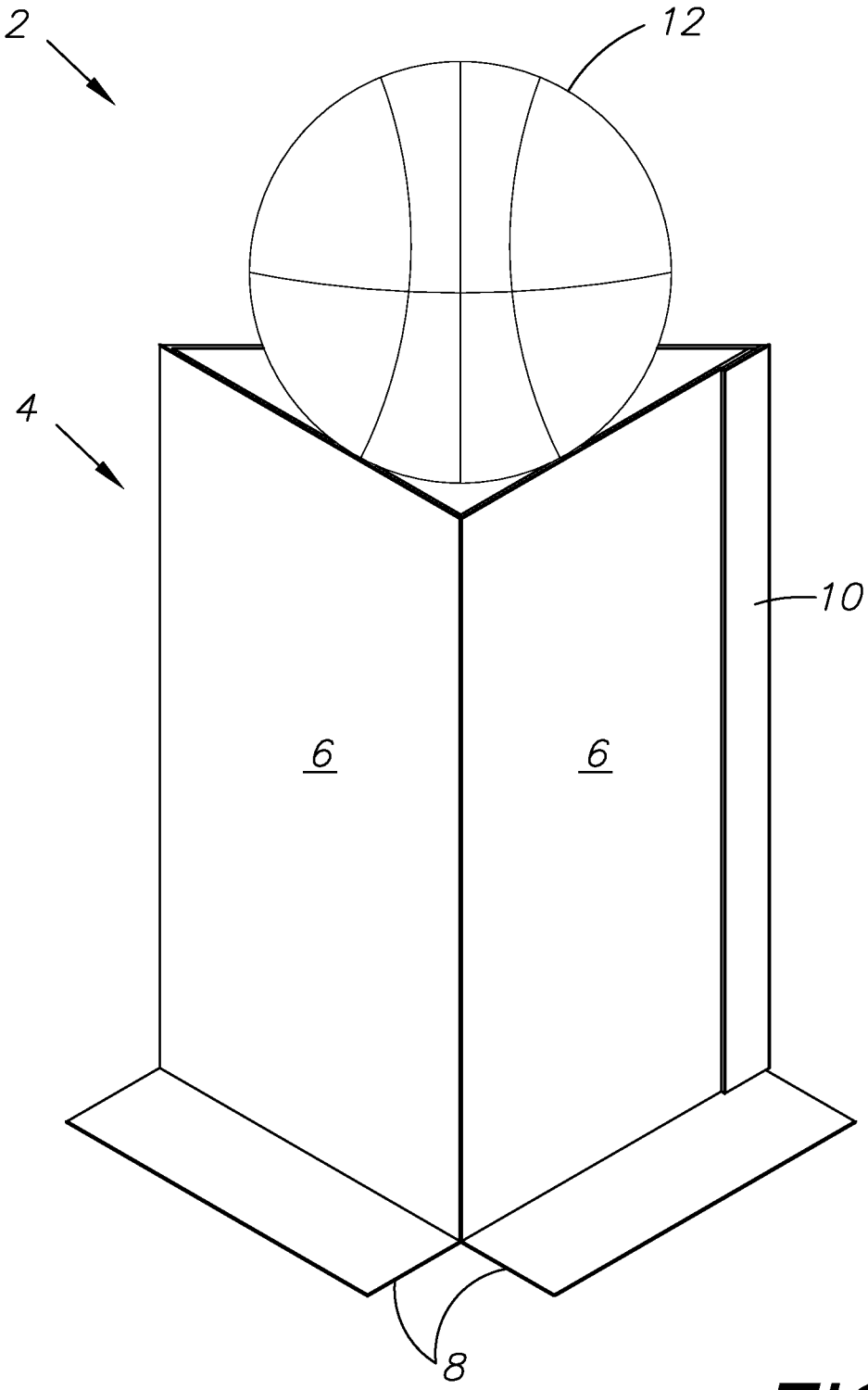
FIG. 1 is an isometric view of an assembled drill tower with a basketball located on top of the tower representing a typical environment.

Referring to the figures in more detail, FIG. 1 shows a drill tower 4 as it would typically fit into a sports training system 2. In this particular scenario, a basketball 12 is placed atop the tower 4 which is oriented in an upright position. The tower is comprised of three panels 6 which terminate at their base into three respective base flaps 8. These flaps add stability to the base, as well as friction against a floor or ground surface to prevent the tower from toppling or sliding while in use. A closure flap 10 secures two end panels 6 together, thereby forming a triangular-prism shaped tower. The flap may employ hooks, straps, hook-and-loop fasteners, snaps, or any other suitable and reusable means to fasten the two end panels 6 together.

Figure 2:
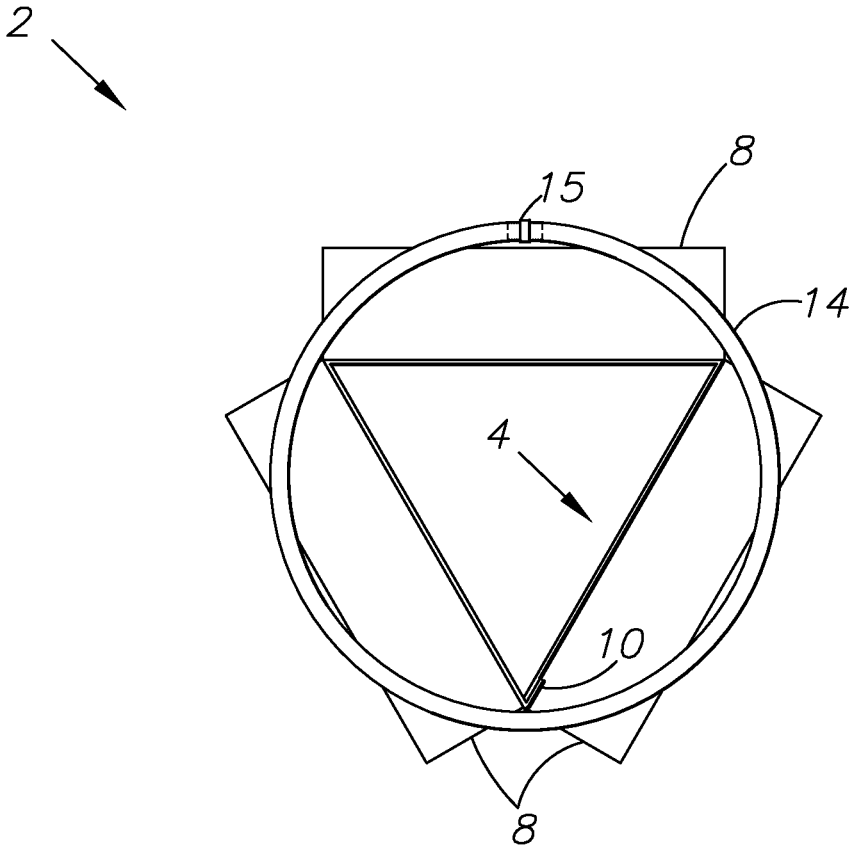
FIG. 2 is a top plan elevational view of an assembled drill tower incorporating a weighted ring.

FIG. 2 shows a top-down view of an assembled drill tower 4. A weighted ring 14 is placed over the top of the tower, such that it loosely fits against the corners where the panels 6 intersect, and lays atop the base flaps 8. This weighted ring 14 provides additional stability to the tower, preventing the tower from teetering or sliding when drills are run from or around the tower 4.

For instance, a player may grab a basketball from atop the tower, as shown positioned in FIG. 1. During this action, the player may drag the ball against the inside face of a panel 6, thereby pulling the panel toward them. This movement could cause the tower to move, slide, or tilt. The weighted ring helps to prevent the tower from moving in such an instance, or if a player accidentally bumps into a tower while running a drill.

The ring 14 is a generally tubular cross-sectional shape. A preferred embodiment is comprised of a flexible or semi-flexible material, such as rubber or vinyl hose. The ring itself may be filled with a weighted element, such as sand, water, weighted pellets, or other means. Alternatively, the ring itself may be made of a heavier material, such as solid rubber or steel. A preferred embodiment would be comprised of a flexible material, however, allowing for the rings to be easily stored in a storage bag along with a collapsed drill tower. A vinyl plumbing hose filled with sand which the two ends of the hose are connected to each other by a barbed plug 15 fitted into each end of the hose is one example of such a ring.

Figure 3:
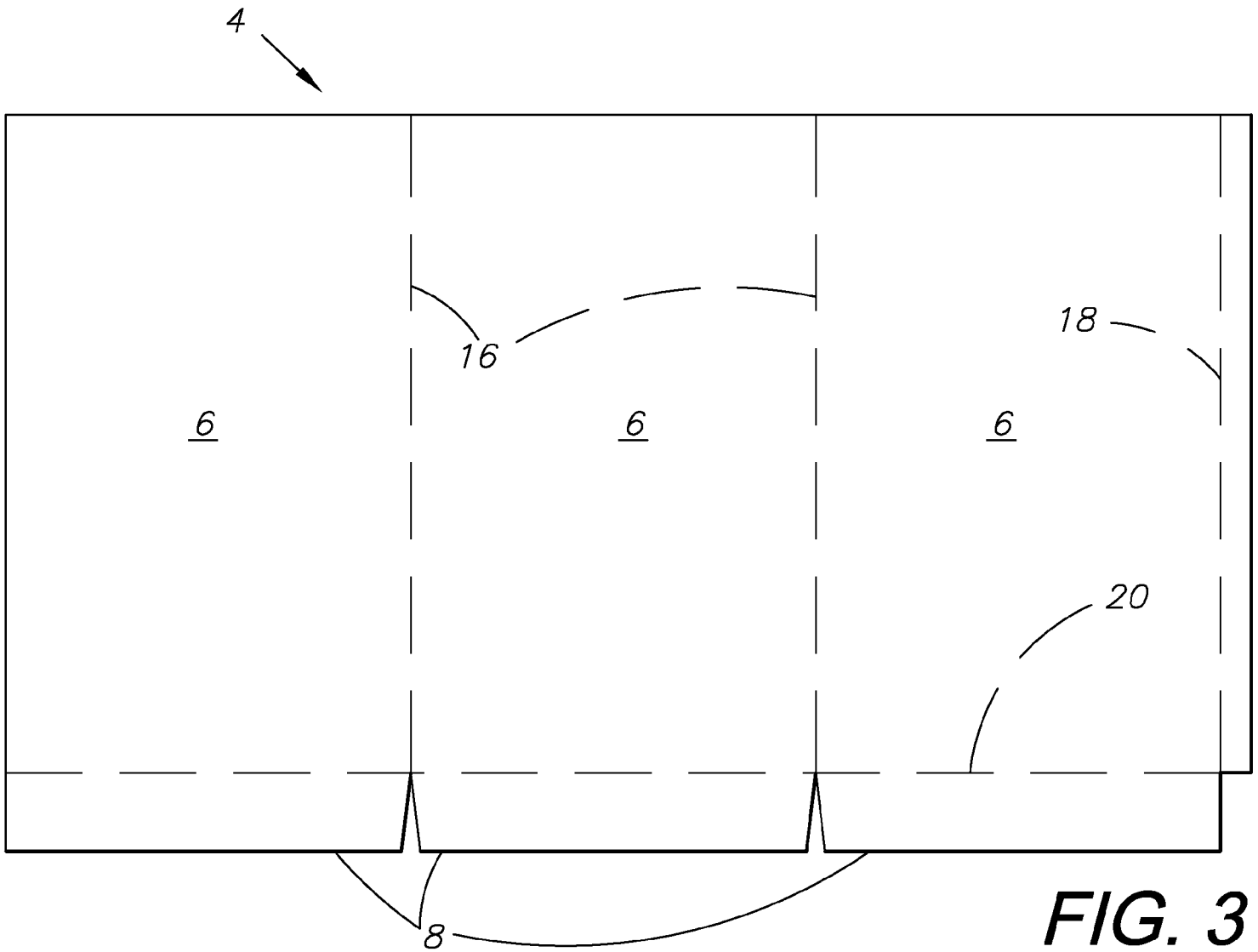
FIG. 3 is a plan view of a drill tower in a disassembled, laid-flat position.
Figure 4:
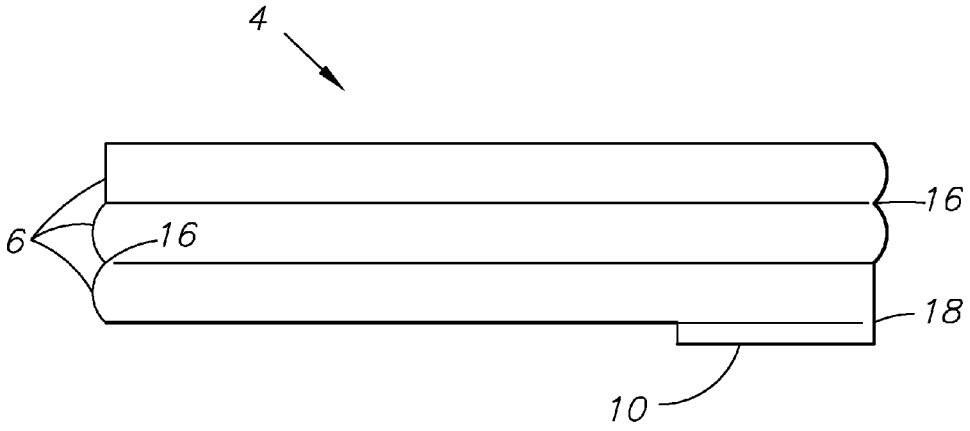
FIG. 4 is a side elevational view of a drill tower in a disassembled, folded position for storage.

FIG. 3 shows a drill tower 4 in a disassembled position laid flat against a surface. FIG. 3 demonstrates that the panels 6 fold along a pair of panel folding lines 16, allowing the panels to fold in upon one another in a "Z" fold, as shown in more detail in FIG. 4. The closure flap 10 is attached to an end panel 6 by a closure flap folding line 18. Similarly, each base flap 8 is affixed to a respective panel 6 by a base flap folding line 20.

Figure 5:
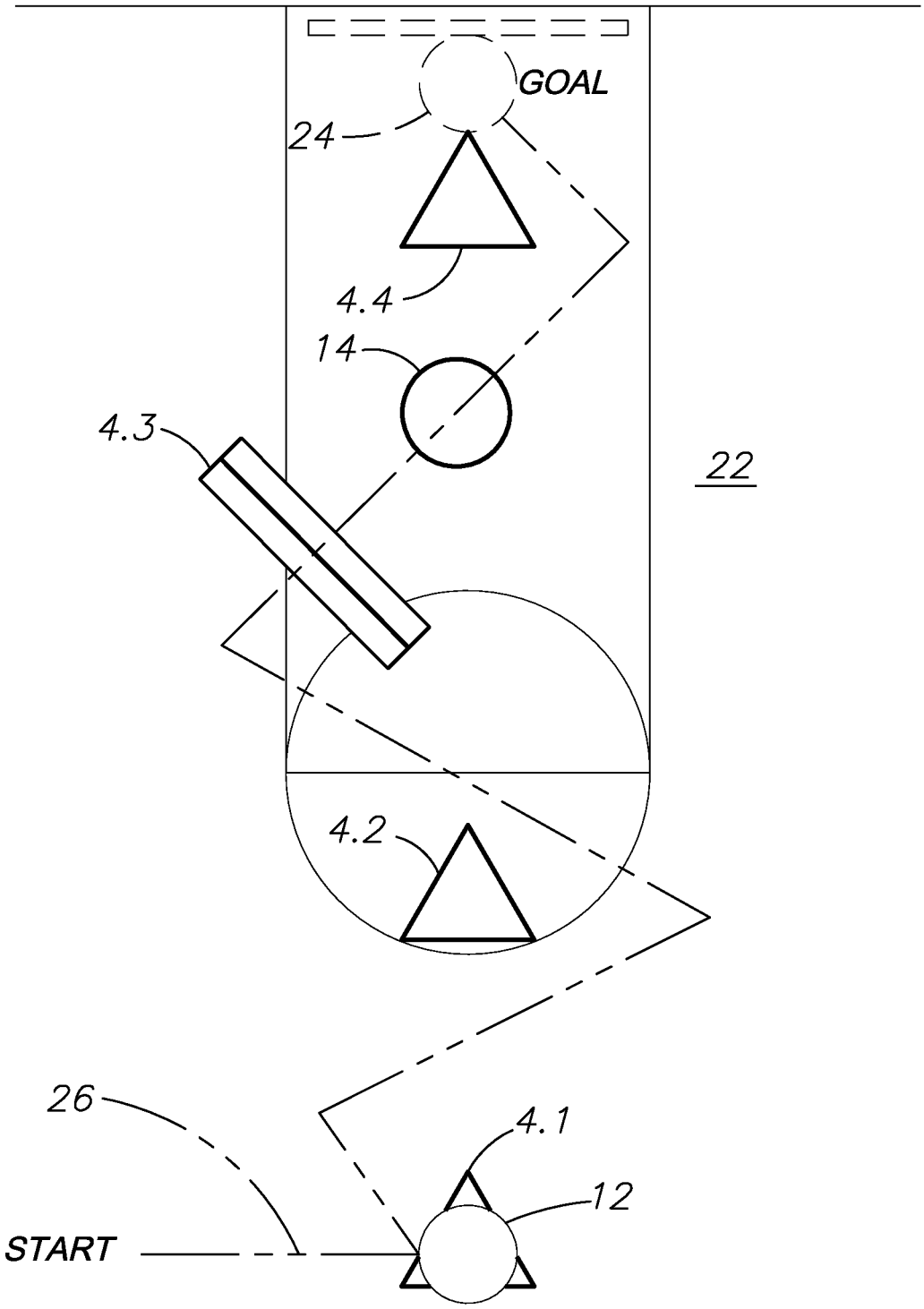
FIG. 5 is a diagrammatic top-plan view of a basketball court acting as environment in which an embodiment of the present invention is practiced.

FIG. 5 shows one example of a drill which may be incorporated using the training system 2 of the present invention. A number of drill towers 4.1, 4.2, 4.3, 4.4 are positioned in various locations on a basketball court 22. A basket 24 is located at a GOAL location. A player would be instructed to start at the START location. The instructed path 26 indicates how the player should navigate the various obstacles.

In the example shown, the player would grab a ball 12 located atop the first drill tower 4.1, cut between the first tower 4.1 and the second tower 4.2, cut back across in front of the second tower 4.2, and stop in front of the third tower 4.3, which is laid along the ground. The player would navigate over the third tower 4.3 while maintaining control of the ball, stepping into and out of a weighted ring 14 located on the court, and navigate around the fourth and final tower 4.4, after which the player should score the ball 12 into the basket 24.

This is just one of many examples of how the training system 2 could be used to instruct players to run drills incorporating one or more drill towers 4. Other examples include, but are not limited to: running high-knee drills over a number of towers laid down on their sides in a field; passing between upright drill towers while players shuffle along a line of towers; and shooting a number of basketballs from different locations on a court, each ball initially placed atop a respective tower.

An additional component of the training system 2 would be a well-thought out skill development matrix, showing and describing the player skills being developed based upon which drills are executed by the player in combination with the drill tower 4. This matrix would be customizable, and benefits both the coach and the player. It would provide tried and tested skill drills aimed improving any and all aspects of the player's game.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A sports training system comprising:

a drill tower including a first panel joined to a second panel by a folding connection, a third panel joined to said second panel by a second folding connection, a closure flap joined to said third panel by a third folding connection, and three base flaps, each said base flap connected to a respected first, second, and third panel by a respective folding connection;

said first panel including a first connector, said closure flap including a second connector, and wherein said second connector is adapted for releasably connecting to said first connector;

said drill tower adapted for transforming between a first, disassembled arrangement and a second, assembled arrangement, wherein said second, assembled arrangement has a generally triangular cross-section;

wherein said drill tower is positioned in an athletic training venue;

wherein said three base flaps are placed on surface such that each flap is perpendicular to a respective first, second, and third panel; and a weighted ring placed over said drill tower such that it rests on a top face of said three base flaps.

2. The sports training system of claim 1, further comprising a ball placed on a top end formed by said first, second, and third panels of said drill tower.

3. The sports training system of claim 1, wherein said weighted ring comprises a vinyl hose filled with sand.

4. The sports training system of claim 1, further comprising a second drill tower including a first panel joined to a second panel by a folding connection, a third panel joined to said second panel by a second folding connection, a closure flap joined to said third panel by a third folding connection, and three base flaps, each said base flap connected to a respected first, second, and third panel by a respective folding connection, wherein said second drill tower is placed in said second, assembled arrangement such that one of said first, second, and third panels is adjacent to a base surface.

5. The sports training system of claim 1, further comprising a second weighted ring placed in proximity to second drill tower.

6. The sports training system of claim 5, wherein said weighted rings comprises a vinyl house filled with sand.

7. The sports training system of claim 1, wherein said drill tower is comprised of a lightweight, water-proof, durable material.

8. The sports training system of claim 7, further comprising:

wherein said lightweight, water-proof, durable material comprises plastic.

9. A drill tower comprising:

a first panel connected to a second panel by a first folding connection;

a third panel connected to said second panel by a second folding connection;

a connector panel connected to said third panel by a third folding connection;

a first base flap connected to said first panel by a fourth folding connection;

a second base flap connected to said second panel by a fifth folding connection;

a third foot flap connected to said third panel by a sixth folding connection;

each of said first panel, second panel, third panel, connector panel, first base flap, second base flap, and third base flap including a front face and a rear face;

wherein the drill tower is adapted for transforming from a first, disassembled construction to a second, assembled construction;

wherein said second, assembled construction comprises a generally triangular cross section wherein each of said first base flap, second base flap, and third base flap are placed against a surface perpendicular to a respective first panel, second panel, and third panel, such that the rear face each of said first base flap, second base flap and third base flap are placed adjacent to said surface;

a first connector affixed to the rear face of said connector panel;

a second connector affixed to the front face of said first panel;

wherein said first connector is adapted for releasably attaching to said second connector;

wherein said three base flaps are placed on surface such that each flap is perpendicular to a respective first, second, and third panel; and a weighted ring placed over said drill tower such that it rests on a top face of said three base flaps.

10. The drill tower according to claim 9, wherein said first connector and said second connector comprise a hook-and-loop fastener.

* * * * *